United States Patent [19]

Schoenemann et al.

[11] 3,956,536

[45] May 11, 1976

[54] SURFACE PRETREATMENT OF STEEL PRIOR TO ENAMELING

[75] Inventors: Rudolf Schoenemann, Dusseldorf-Holthausen; Rudolf Reitzenstein, Traunreut, both of Germany

[73] Assignee: Henkel & Cie G.m.b.H., Dusseldorf-Holthausen, Germany

[22] Filed: Nov. 25, 1974

[21] Appl. No.: 526,626

Related U.S. Application Data

[62] Division of Ser. No. 303,512, Nov. 3, 1972, abandoned.

[30] Foreign Application Priority Data

Nov. 5, 1971 Germany ..... 2154938

[52] U.S. Cl. ..... 427/328; 427/309; 427/330; 134/28; 134/41

[51] Int. Cl.[2] ..... C23G 1/06; C23D 3/00

[58] Field of Search ..... 117/53, 50, 70 C, 129; 134/41, 26, 28; 156/18; 427/309, 328, 330

[56] References Cited

UNITED STATES PATENTS

| | | | |
|---|---|---|---|
| 2,981,633 | 4/1961 | Davis et al. | 117/50 |
| 3,317,340 | 5/1967 | Ziehr et al. | 117/53 |
| 3,368,913 | 2/1968 | Ziehr et al. | 117/53 |

*Primary Examiner*—Ralph S. Kendall
*Attorney, Agent, or Firm*—Hammond & Littell

[57] ABSTRACT

A method for the surface treatment of steel, preferably non-decarburized steel, capable of being enameled comprises the steps of degreasing the metal surface; optionally descaling the metal surface in an acid bath; treating the metal surface with an aqueous solution containing from 0.1% to 5% by weight of at least one complex former which prevents the precipitation of heavy metal cations at the pH employed; intensively pickling the metal surface; and nickelplating the metal surface.

10 Claims, No Drawings

SURFACE PRETREATMENT OF STEEL PRIOR TO ENAMELING

This is a division of Ser. No. 303,512, filed Nov. 3, 1972, now abandoned.

PRIOR ART

It is known that the direct-white enameling of steel sheet requires a particularly careful pretreatment of the metal surfaces. This careful pretreatment is also required during the direct enameling with bright color tones. It is customary, therefore, to degrease the steel metal parts with an alkaline media in several stages, to optionally descale them in an acid bath if required, to then pickle them intensively, and finally to nickelplate them before the enamel is applied. To avoid carrying the chemicals over from one stage to the next, the work pieces are rinsed with warm and/or cold water between the various preparatory steps.

The known methods for direct-white enameling are primarily employed where steel alloys of extremely low carbon content of approximately 0.001 to 0.015% by weight are involved. These "decarburized" steels are obtained by vacuum degasification of the liquid steel or by annealing the already rolled metal in a reducing atmosphere. Depending on the way in which they are produced, these steel types are called VAC steels (vacuum decarburized) or OC steels (decarburized by the Open Coil method). There are also other known methods for the direct-white enameling of normal steels which have a carbon content of up to 0.15%. These "normal steels" are undecarburized steels.

However, the direct-white enameling process for normal steels is not yet generally acceptable for mass production methods. One substantial difficulty preventing the general use of normal steels in the direct-white enameling process is the appearance of numerous minute faults, or spots, in the enamel coat, not visible as such to the naked eye. It is this phenomenon which is responsible for the fact that the other-wise white enamel coating has an undesirable gray tone.

Even when enameling OC and VAC steels, enamel faults, such as gray spots, are frequently produced which cannot be prevented by the pretreatment of the metal surface by the hitherto known methods. These difficulties are probably caused by uncontrollable factors which are present during the manufacturing and processing operations that the steel sheets undergo.

OBJECTS OF THE INVENTION

It is an object of the present invention to provide a process for the surface treatment of steel which overcomes the above-described difficulties.

It is another object of the present invention to provide a method for the surface treatment of normal or decarburized steel capable of being enameled comprising the steps of degreasing the metal surface; optionally descaling the metal surface in an acid bath; treating the metal surface with an aqueous solution containing from 0.1 to 5% by weight of at least one complex former which prevents the precipitation of heavy metal cations at the pH employed; intensively pickling the metal surface; and nickelplating the metal surface.

It is a further object of the present invention to provide a development in a method for the surface treatment of normal or decarburized steel capable of being enameled, comprising the steps of degreasing the metal surface, optionally descaling the metal surface in an acid bath, intensively pickling the metal surface, and nickelplating the metal surface; in which the improvement comprises treating the metal surface with an aqueous solution containing at least one complex former which prevents the precipitation of heavy metal cations at the pH employed; prior to said intensive pickling of the metal surface.

Other and further objects of the invention will become apparent as the description thereof proceeds.

DESCRIPTION OF THE INVENTION

The present invention is directed to a method for the surface treatment of normal or decarburized steel capable of being enameled comprising the steps of degreasing the metal surface; optionally descaling the metal surface in an acid bath; treating the metal surface with an aqueous solution containing from 0.1 to 5% by weight of at least one complex former which prevents the precipitation of heavy metal cations at the pH employed; intensively pickling the metal surface; and nickelplating the metal surface.

The present invention is further directed to a development in a method for the surface treatment of normal or decarburized steel capable of being enameled, comprising the steps of degreasing the metal surface, optionally descaling the metal surface in an acid bath, intensively pickling the metal surface, and nickelplating the metal surface; in which the improvement comprises treating the metal surface with an aqueous solution containing at least one complex former which prevents the precipitation of heavy metal cations at the pH employed, prior to said intensive pickling of the metal surface.

Examples of suitable complex formers for carrying out the process according to the invention are water soluble cyanides, for example alkali metal cyanides such as sodium cyanide or potassium cyanide, and alkanolamines containing at least three hydroxy groups, preferably containing from 6 to 18 carbon atoms, such as triethanolamine, triisopropanolamine and N,N,N',N'-tetrakis-(2-hydroxyethyl)-ethylenediamine. Other examples of suitable complex formers are the following acids or their water soluble salts, for example the alkali metal salts and in particular the sodium and potassium salts: polycarboxylic acids of 2 to 10 carbon atoms, for example alkane polyoic acids of 2 to 10 carbon atoms such as oxalic acid; hydroxypolycarboxylic acids of 3 to 10 carbon atoms, for example hydroxyalkane polyoic acids of 3 to 10 carbon atoms such as citric acid; polyhydroxycarboxylic acids of 2 to 10 carbon atoms, for example polyhydroxyalkanoic acids of 2 to 10 carbon atoms such as gluconic acid and heptahydroxyheptanoic acid; polyhydroxypolycarboxylic acids of 4 to 10 carbon atoms, for example polyhydroxy alkanepolyoic acids of 4 to 10 carbon atoms such as tartaric acid and saccharic acid; aminopolycarboxylic acids of 6 to 18 carbon atoms, for example amino-(alkanoic acids) of 6 to 18 carbon atoms, such as nitrilotriacetic acid and ethylenediaminetetracetic acid; polyphosphonic acids, such as 1-hydroxyalkane-1,1-diphosphonic acids of 1 to 10 carbon atoms such as 1-hydroxyethyethane-1,1-diphosphonic acid and 1-hydroxyhexane-1,1-diphosphonic acid; 1-hydroxy-phenylalkane-1,1diphosphonic acid having 7 to 16 carbon atoms, such as 1-hydroxy-2-phenylethane-1,1-diphosphonic acid; 1-aminoalkane-1,1-diphosphonic acids of 1 to 10 carbon atoms, such as 1-aminoethane-1,1-diphosphonic acid and 1-aminobutane-1,1-diphosphonic acid; 1-amino-phenylalkane-1,1-diphosphonic acids of 7 to 16 carbon atoms, such as 1-amino-1-phenylmethane-1,1-diphosphonic acid; 1-(N,N-disubstitutedamino)-alkane-1,1-diphosphonic acid of 3 to 16 carbon atoms, such as 1-(N,N-dimethylamino)-methane-1,1-diphosphonic acid; as well as amino-(alkylene-phosphonic acids) of 3 to 18 carbon atoms, for example aminomethylene phosphonic acids of 3 to 18 carbon atoms, such as nitrilotri(methylene phosphonic acid) and ethylenediaminotetra-(methylenephosphonic acid). These complex formers mentioned above can be utilized singularly or as mixtures thereof.

Particularly effective solutions are those which contain a complex former mixture composed of a trialkanolamine of 6 to 18 carbon atoms, an aminopolycarboxylic acid of 6 to 18 carbon atoms and/or a polyhydroxycarboxylic acid of 2 to 10 carbon atoms, or contain a mixture of one of the diphosphonic acids of 1 to 16 carbon atoms or polyphosphonic acids of 3 to 18 carbon atoms and a polyhydroxycarboxylic acid of 2 to 10 carbon atoms.

The complex former solutions utilized may be either acid, neutral or alkaline, but the solution must be controlled such that the complex formers used will prevent the precipitation of heavy metal cations in the pH range employed. Preferably a strongly alkaline solution is employed.

The standardization of the desired pH value may be accomplished by suitable combinations of acid and alkaline complex formers or by the addition of hydroxides, carbonates, hydrogencarbonates, silicates, borates, orthophosphates, pyrophosphates and polyphosphates of the alkali metals, in particular of sodium and potassium. Also, wetting agents not acting as pickling inhibitors during the succeeding intensive pickling operation may be added to the solutions.

In general the overall concentration of the complex formers present in the solutions should be between 0.1 and 5% by weight. It is preferred to use solutions containing from 0.3 to 1.5% by weight of complex formers. The temperature of the solutions may range from 15° to 90°C. The treatment time should range from about 1 to about 10 minutes.

The metal surface treatment step by means of complex formers according to the invention may be interposed prior to the intensive pickling as an additional step in any conventional sequence of baths for the pretreatment of steel before direct-white enameling it. It is advisable to have a water rinse follow the treatment with the complex former solution, in order to prevent chemicals from being carried over into the subsequent acid bath for the intensive pickling operation.

The novel method according to the invention has the advantages that the appearance of gray spots in the white enamel coating is substantially or completely avoided during and after the direct-white enameling processing of normal steel. For direct-white enameling of OC and VAC steels, this novel method produces a considerable quality improvement in the enamel coatings, once again without there being any appearance of gray spots in the white enamel coating.

The following examples are merely illustrative of the present invention without being deemed limitative in any manner thereof.

The percentages given are by weight.

EXAMPLE 1

Completely degreased, cold rolled steel sheet of the drawing quality, USt 12 DIN 1623-Sheet 1 (maximum carbon content 0.1%) was descaled at 70°C with an aqueous solution of 8% sulfuric acid, and then was rinsed with cold water. The sheets were then treated at 50°C with a solution which contained 1.5 g/l NaOH
1.0 g/l triethanolamine
1.0 g/l tetrasodium salt of ethylenediamine-tetraacetic acid and rinsed with cold water. The intensive pickling operation was carried out at 75°C with an aqueous solution of 15% sulfuric acid. After an intermediate cold water rinse, the pickled steel surfaces were nickelplated without the use of an electric current with a solution containing nickel sulfate, and then were rinsed with hot water (75°C). To passivate the sheets, they were treated at 80°C with an aqueous solution containing 0.5% of a mixture of 3 parts sodium nitrate and 1 part borax. The sheets were then dried at 110°C. The treatment was carried out by the immersion method. The treatment time in the various baths amounted to approximately 5 minutes. The thusly pretreated steel sheets gave a very satisfactory enamel coating by the direct-white method, that was free from gray spots.

Enamel coatings of comparable qualities were obtained when the above complex former solution was replaced by a solution of the following composition in the above-described sequence of treatment baths:

(b)

4.5 g/l NaOH
2.0 g/l $Na_2SiO_3 \cdot 5H_2O$
1.5 g/l $Na_5P_3O_{10}$
1.3 g/l triethanolamine
0.5 g/l sodium gluconate
0.2 g/l tetrasodium salt of ethylenediamine tetraacetic acid (c)

8.0 g/l NaOH
8.0 g/l triisopropylamine
4.0 g/l nitrilotriacetic acid (d)

2.0 g/l NaOH
4.0 g/l sodium gluconate
4.0 g/l tetrasodium salt of 1-hydroxyethane-1,1-diphosphonic acid

EXAMPLE 2

Vacuum decarburized USt 12-03 VAC steel sheets, (maximum carbon content 0.015%) were degreased until completely water wettable, were descaled at 55°C with an aqueous solution of wettable, were descaled at 55°C with an aqueous solution of 10% sulfuric acid, were rinsed with cold water, and were then treated at room temperature with an aqueous solution of 0.5% sodium cyanide.

After an intermediate cold water rinse, the sheets were intensively pickled at 65°C with an aqueous solution of 20% sulfuric acid, were again rinsed with cold water, and were then nickelplated without electric current at 80°C in an aqueous solution containing 1.5% $NiSO_4 \cdot 7H_2O$. A hot water rinse at 75°C followed. The metal surfaces were subsequently passivated ty treating them with an aqueous solution of 0.5% sodium nitrate at 90°C, and were finally dried at 110°C. The entire treatment was carried out by the immersion method. The average treatment time in the various baths amounted to 6 minutes. The thusly pretreated sheets were enamelled by one of the conventional direct-white methods, and faultless enamel coatings were obtained which were free from gray spots.

Comparable results were achieved when the sodium cyanide was replaced by citric acid or oxalic acid as the complex former.

EXAMPLE 3

Decarburized steel sheets USt 12 OC (decarburized by the Open Coil method; maximum carbon content 0.004%) were degreased until completely water wettable, were descaled at 80°C with an aqueous solution of 10% sulfuric acid and were rinsed with cold water. The sheets were subsequently treated at 55°C with a complex former solution which contained 4 g/l NaOH
4 g/l sodium gluconate
4 g/l triethanolamine or with an aqueous 1% solution of 1-hydroxyethane-1,1-diphosphonic acid. After a cold water rinse, the sheets were intensively pickled, were nickelplated without electric current, were passivated and were dried according to the procedure described in Example 2.

Direct-white enameling of the thusly pretreated steel sheets produced faultlessly formed enamel coating thereon, which were free from gray spots.

Although the present invention has been disclosed in connection with a few preferred embodiments thereof, variations and modifications may be resorted to by those skilled in the art without departing from the principles of the new invention. All of these variations and modifications are considered to be within the true spirit and scope of the present invention as disclosed in the foregoing description and defined by the appended claims.

What is claimed is:

1. A process for the direct-white enameling of a normal or decarburized steel surface consisting essentially of degreasing the metal surface; treating the metal surface with an aqueous solution containing from 0.1 to 5% by weight of at least one complex former which prevents the precipitation of heavy metal cations at the pH employed said complex former being selected from the group consisting of an alkali metal cyanide, an organic complex former and the mixtures thereof, intensively acid pickling the metal surface; nickelplating the metal surface; and direct-white enameling said nickelplated surface.

2. The method of claim 1, in which the steel is normal steel.

3. The method of claim 1, in which the metal surface is treated for 1 to 10 minutes at a temperature from 15° to 90°C.

4. The method of claim 3, in which said aqueous solution contains from 0.3 to 1.5% by weight of said complex former.

5. The method of claim 1, in which the metal surface is rinsed with water subsequent to the treatment with the complex former solution and before the intensive pickling.

6. The method of claim 1, in which the organic complex former is selected from the group consisting of a trialkanolamine of 6 to 18 carbon atoms, an aminopolycarboxylic acid of 6 to 18 carbon atoms, a polyhydroxycarboxylic acid of 2 to 10 carbon atoms, and the mixtures thereof.

7. The method of claim 1, in which the organic complex former is selected from the group consisting of a diphosphonic acid of 1 to 16 carbon atoms, a polyphosphonic acid of 3 to 18 carbon atoms, a polyhydroxycarboxylic acid of 2 to 10 carbon atoms and the mixtures thereof.

8. The method of claim 1, in which said complex former is selected from the group consisting of (1) an alkali metal cyanide, (2) an alkanolamine containing at least three hydroxy groups and from 6 to 18 carbon atoms, (3) organic acids selected from the group consisting of polycarboxylic acids of 2 to 10 carbon atoms, hydroxypolycarboxylic acids of 3 to 10 carbon atoms, polyhydroxycarboxylic acids of 2 to 10 carbon atoms, polyhydroxypolycarboxylic acids of 4 to 10 carbon atoms, aminopolycarboxylic acids of 6 to 18 carbon atoms, 1-hydroxyalkane-1,1-diphosphonic acid of 1 to 10 carbon atoms, 1-hydroxy-phenylalkane-1,1-diphosphonic acid having 7 to 16 carbon atoms, 1-aminoalkane-1,1-diphosphonic acid of 1 to 10 carbon atoms, 1-amino-phenylalkane-1,1-diphosphonic acid of 7 to 16 carbon atoms, 1-(N,N-disubstituted-amino)-alkane-1,1-diphosphonic acid of 3 to 16 carbon atoms, amino-(alkylene-phosphonic acid) of 3 to 18 carbon atoms, and their alkali metal salts and (4) mixtures thereof.

9. The method of claim 1 wherein the steel is descaled steel.

10. In a method for the surface treatment of normal or decarburized steel capable of being enameled, consisting essentially of degreasing the metal surface, intensively acid pickling the metal surface, nickelplating the metal surface and direct-white enameling said nickelplated surface; the improvement which comprises treating the metal surface with an aqueous solution containing at least one complex former which prevents the precipitation of heavy metal cations at the pH employed, said complex former being selected from the group consisting of an alkali metal cyanide, an organic complex former and the mixtures thereof, immediately prior to said intensive acid pickling of the metal surface.

* * * * *